United States Patent [19]

Gess

[11] 4,094,125

[45] June 13, 1978

[54] PACKAGING MACHINE

[76] Inventor: Larry C. Gess, 13345 Dunlap Rd., LaSalle, Mich. 48145

[21] Appl. No.: 737,602

[22] Filed: Nov. 1, 1976

[51] Int. Cl.[2] ..... B65B 5/02; B65B 43/00

[52] U.S. Cl. ..... 53/29; 53/183; 53/384; 53/386

[58] Field of Search ..... 53/28, 29, 179, 183, 53/187, 384, 385, 386, 266

[56] References Cited

U.S. PATENT DOCUMENTS

| | | | |
|---|---|---|---|
| 2,927,410 | 3/1960 | Doyen et al. | 53/268 |
| 3,201,914 | 8/1965 | Lohse et al. | 53/187 |
| 3,779,121 | 12/1973 | Lagain | 83/614 |
| 3,792,565 | 2/1974 | Goransson | 53/183 |
| 3,889,449 | 6/1975 | Membrino | 53/266 X |
| 3,948,019 | 4/1976 | Döring et al. | 53/386 X |

*Primary Examiner*—Robert Louis Spruill
*Attorney, Agent, or Firm*—Allen D. Gutchess, Jr.

[57] ABSTRACT

A packaging machine is provided for packaging articles, using a source of packaging material in the form of a length of plain, plastic tubing. The machine has two stations for faster production. At the first station, the tubing is heat sealed along a strip extending transversely thereof and is severed to form a package section. A separate section with the lower end heat sealed is then transferred to the second station. Here, the upper edges are opened, an article is deposited, and the upper edge is then closed and sealed. The operations at the two stations are performed simultaneously to enable a greater production rate to be achieved.

16 Claims, 12 Drawing Figures

PACKAGING MACHINE

This invention relates to an improved machine for packaging articles.

The new packaging machine according to the invention utilizes as a source of packaging material a plain plastic tubing. The tubing has no preformed seals or slits therein, thereby to provide a low-cost supply of packaging material.

The new packaging machine has two stations with operations being performed at both stations simultaneously, to achieve a faster production rate. The plastic tubing from a coil or roll thereof is fed to the first station. With the leading or lower edge of the tubing heat sealed transversely thereacross, a first section is advanced a predetermined distance to provide a package section of predetermined length. After advancement, the leading edge of a second section of the tubing is then heat sealed while the first section severed just below the heat seal of the second section. The first, severed section is then transferred to the second station located at one side of the first station. At the second station, the first section is held below the top and the upper edges are opened by directing low pressure air past the outer surfaces of the upper edges to pull open these edges. The upper edges are then clamped and moved apart with the section then released therebelow. The article is then deposited in the section through the open top and the upper edges are brought together and heat sealed. The bag is then released and dropped to a discharge conveyor or other surface therebelow. As these operations are being undertaken at the second station, the tubing is advanced a predetermined distance again at the first station with a transverse seal then made at the lower end of what will be the third section and with the second section subsequently severed below the seal. The severed second section is then clamped and transferred to the second section after the completed container or bag is dropped from the second station.

It is, therefore, a principal object of the invention to provide a packaging machine utilizing a supply of packaging material in the form of a length of plain plastic tubing.

Another object of the invention is to provide a two-station packaging machine in which operations are performed simultaneously at both stations to achieve greater production rates.

Many other objects and advantages of the invention will be apparent from the following detailed description of a preferred embodiment thereof, reference being made to the accompanying drawings, in which.

Figure 1:
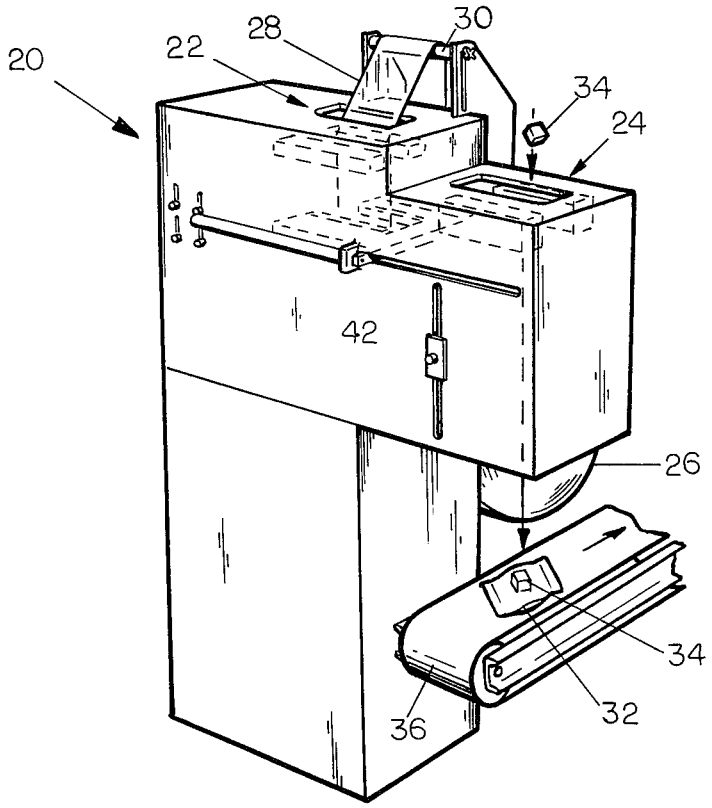
FIG. 1 is a somewhat schematic view in perspective of the overall packaging machine according to the invention.

Referring to the drawings, and particularly to FIG. 1, an overall packaging machine according to the invention is indicated at 20. The machine includes a first station 22 at which advancing, sealing and severing of a supply of plain tubing take place, and a second station 24 at which loading, sealing and discharging take place. The packaging material for the machine is in the form of a roll 26 of flexible, plastic tubing 28 of substantial length to form a multiplicity of packages. The tubing 28 is plain without any slits or preformed seals so as to constitute a relatively inexpensive source of supply. The tubing 28 is fed over an upper roller 30 to the first station 22 and a complete package 32 containing an article 34 is discharged from the second station of the machine onto a conveyor 36 or other suitable package-receiving means.

Figure 2:
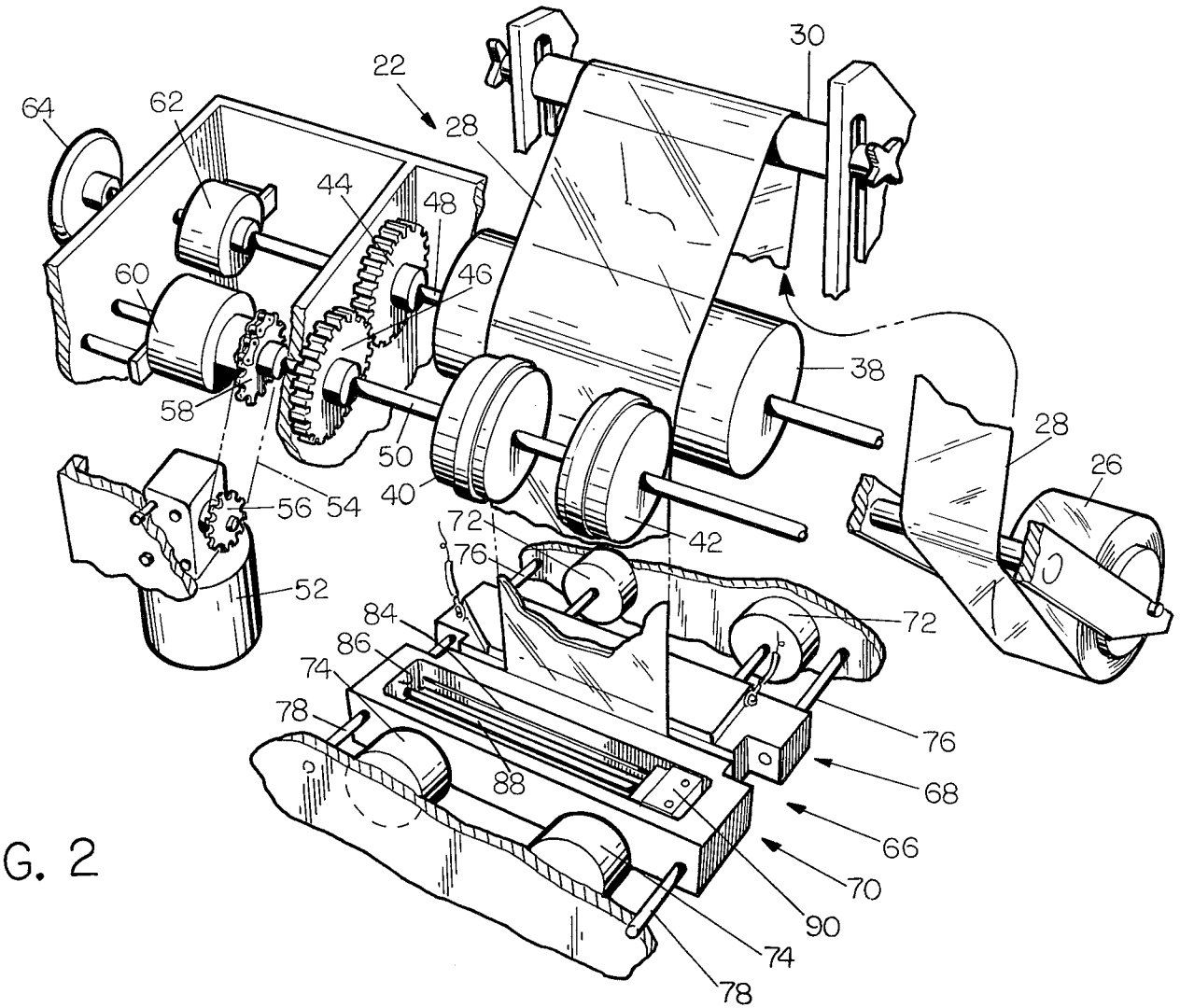
FIG. 2 is a fragmentary view in perspective of an upper portion of the first station of the machine.

Referring now more particularly to FIG. 2, the tubing is fed around the roller 30 and advanced downwardly into the first station 22 by a rear metal roll 38 and two forward, rubber-rimmed rolls 40 and 42. These are connected by spur gears 44 and 46 mounted on shafts 48 and 50. The shaft 50 is driven by a drive motor 52, a chain 54, and sprockets 56 and 58, the latter being connected to the shaft 50 through an electro-magnetic clutch 60. A magnetic brake 62 is mounted on the shaft 48 along with a hand wheel 64 which can be used to manually advance the tubing. The length of advance of the tubing 28 by the rolls 38, 40, and 42 can be controlled either by a timer or a counter, by way of example. When the proper length of tubing is advanced, the electro-magnetic clutch 60 is disengaged and the brake 62 is engaged to stop the rolls immediately and provide close control over the length of the tubing. The tubing 28 is fed downwardly between a pair, indicated at 66, of engageable members 68 and 70. These are moved toward and away from the path of the tubing 28 by fluid-operated cylinders 72 and 74. The members 68 and 70 are mounted on guide rods 76 and 78 to control their inward and outward movement.

Figures 3, 4:
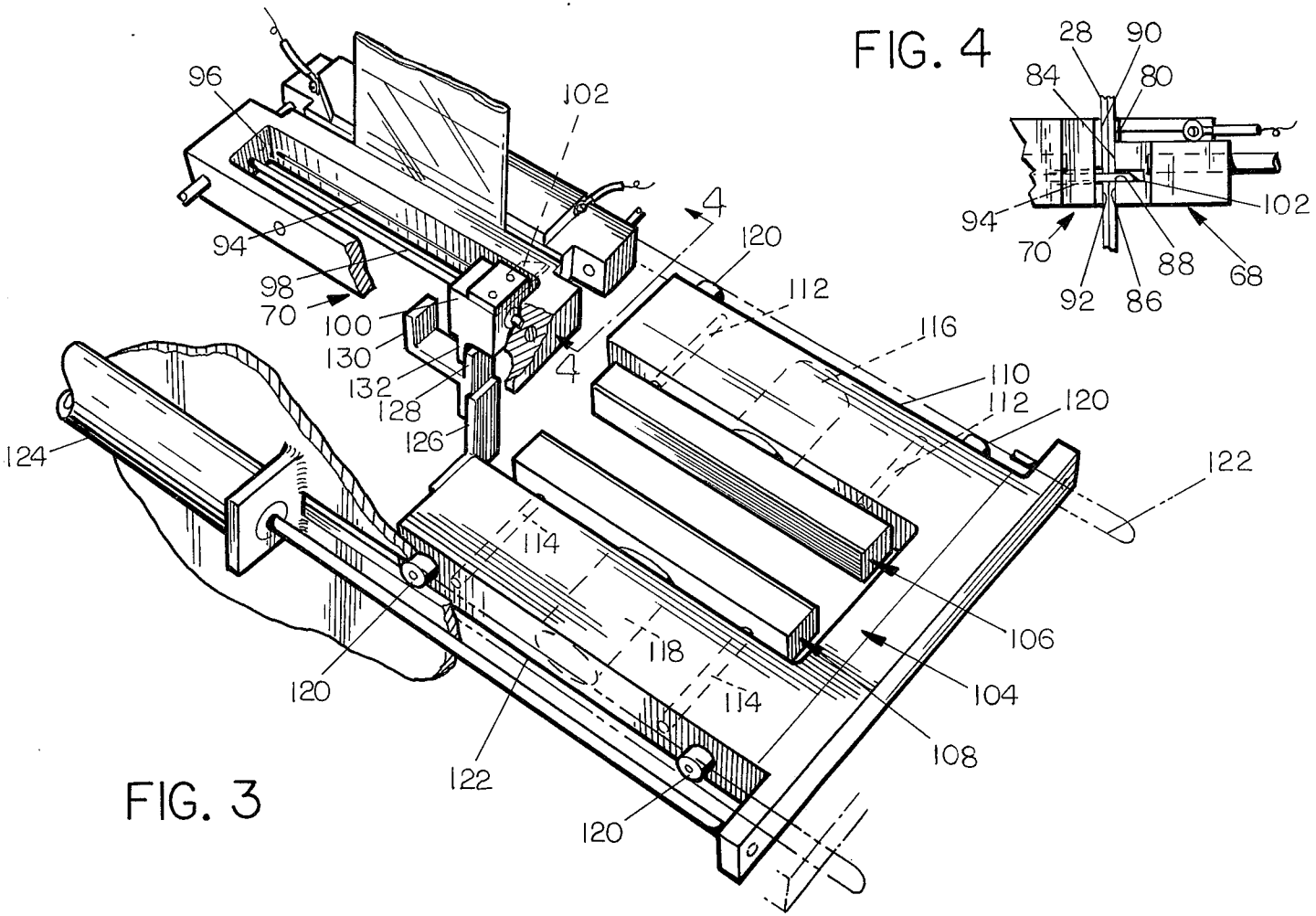
FIG. 3 is a fragmentary view in perspective of a lower portion of the first station.
FIG. 4 is an end view of certain components of FIG. 3 taken along the line 4—4 of FIG. 3.

Referring particularly to FIG. 4, the engageable member 68 has an electrically-heated wire or band 80 which has a length exceeding the width of the tubing 28 and which forms a heat-seal strip transversely of the tubing when engaged therewith and heated. When not in operation, four volts are applied to the heater wire or band 80, with this being increased to 16 volts when the tubing is to be sealed. The engageable member 68 also has two engageable surfaces 84 and 86 located below the heater strip 80, with the two surfaces being separated by a groove 88 which extends the full width of the tubing 28. The engageable member 70 has an upper engageable surface 90 and a lower engageable surface 92 separated by a slot 94 extending the full width of the tubing 28. The upper engageable surface 90 backs up the tubing 28 when it is heat sealed by the strip 80. The engageable member 70 also has an elongate opening 96 carrying a guide rod 98 on which is slidably mounted a guide block 100 carrying a knife blade 102. As shown in FIG. 4, the knife blade 102 is of a length sufficient to extend through the slot 94 of the member 70 and into the groove 88 of the engageable member 68. When the guide block 100 is moved along the guide rod 98 through a path exceeding the width of the tubing 28, the knife blade 102 severs the tubing 28 below the heat-sealed strip. This forms a first package or bag section below the sever line with this section having a heat-sealed strip at the lower edge thereof formed by the heater band 80 in the previous operation. The first bag section now severed from the rest of the tubing 28, is still held below the groove 88 and the blade 102 by the engageable surfaces 86 and 92 of the engageable members 68 and 70.

A pair 104 of transfer engageable members 106 and 108 move the severed package section from the first station to the second. The engageable members 106 and 108 are carried by a yoke 110 through guide rods 112 and 114. The members 106 and 108 are moved toward and away from the package section by fluid-operated cylinders 116 and 118. The yoke 110 has rollers 120 extending through slots 122 in the machine housing to guide the yoke between the first and second stations along a lineal path. The yoke is moved therebetween by a pair of fluid-operated cylinders 124 mounted on the machine housing.

The yoke 110 has an upstanding arm 126 carrying a pair of spaced flanges 128 and 130. These engage a depending flange 132 of the guide block 104 and the knife blade 102 to move the blade across the tubing 28 by cooperation of the flange 128 and the flange 132 as the yoke 110 moves from the second station to the first, with the first pair 66 of engageable members being in the inner position. The engageable members 106 and 108 are then moved inwardly to engage the severed package section a distance below the sever line, with the package section still being held by the lower engageable surfaces 86 and 92 of the members 68 and 70. When these members separate, the second pair 104 of engageable members and the yoke are moved by the cylinders 124 to move this first package section to the second station. At this time, the flange 130 of the drum 126 engages the flange 132 to return the block 100 and the blade 102 back to the side of the tubing toward the second station.

Figure 6:
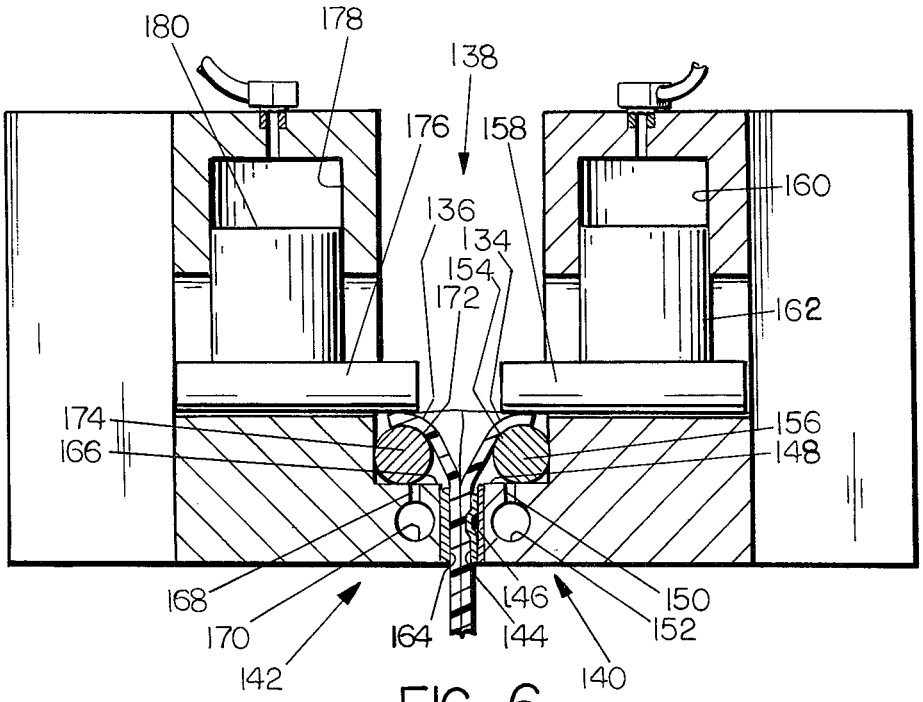
FIG. 6 is a view in transverse cross section taken along the line 6—6 of FIG. 5.
Figure 5:
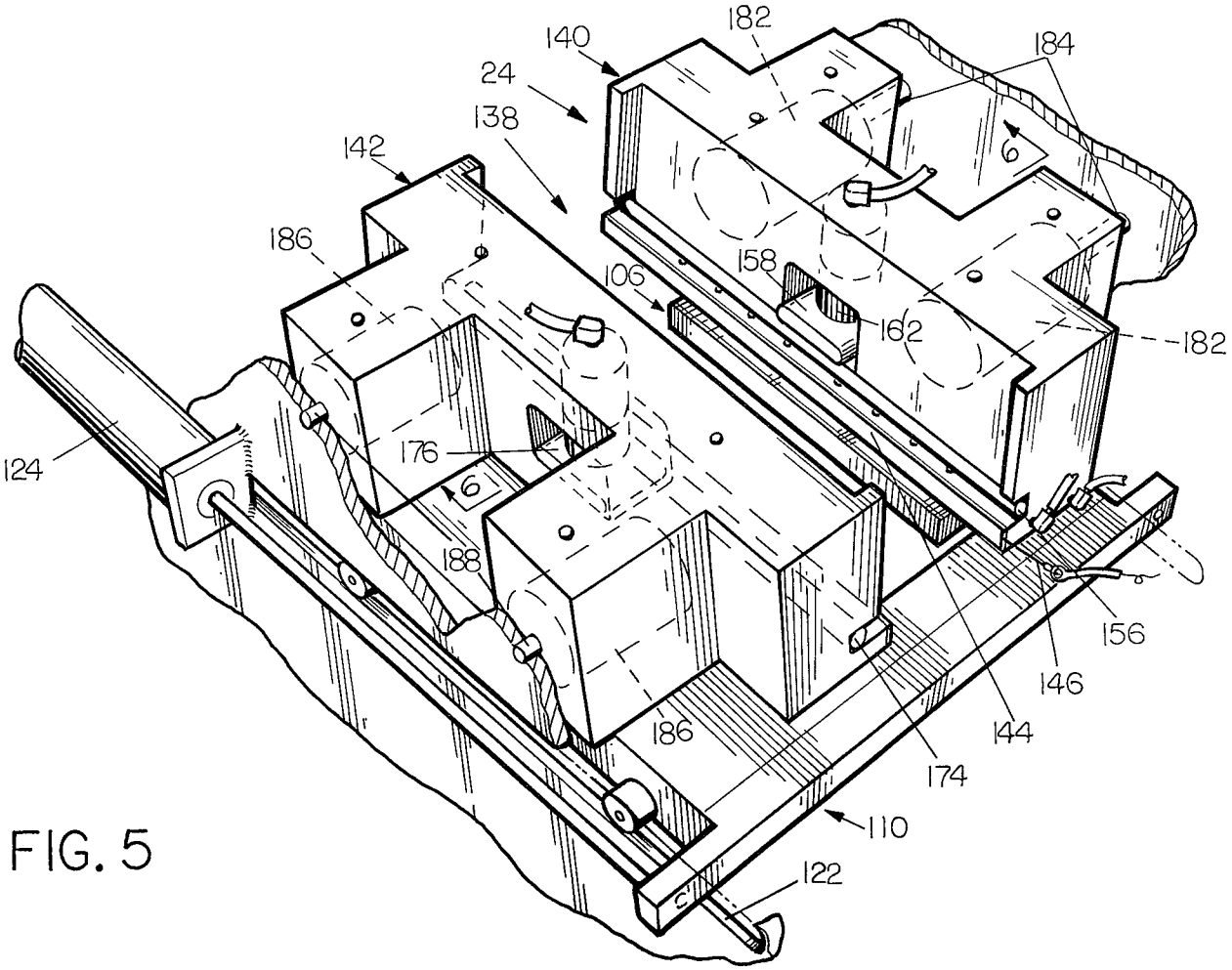
FIG. 5 is a fragmentary view in perspective of the second station of the new packaging machine.

Referring now in more detail to the second station and particularly to FIGS. 5 and 6, the engageable members 106 and 108 engage the first package section a substantial distance below upper edges 134 and 136 thereof. When the engageable members and the yoke 110 move to the second station 24, the upper edges 134 and 136 of the first package section are then moved between a third pair 138 of engageable members 140 and 142. The engageable member 140 has a lower engageable surface 144 there being a heater strip or band 146 at a central, longitudinally-extending portion thereof. Above the surface 144 is a shoulder 148 containing openings or orifices 150 extending longitudinally thereof and communicating with an internal manifold 162. Above the openings 150 is a curved surface 154 positioned approximately tangentially to the openings with the surface 154 being formed, in this instance, by a rod 156. Above the rod 156 is a clamping bar 158 which is movable in a vertical direction between a clamping position adjacent the rod 156 and a spaced position thereabove. The bar 158 is moved between its positions by a fluid-operated cylinder 160 and a piston 162.

The second engageable member 142 has a lower engageable surface 164 above which is a shoulder 166 containing openings or orifices 168 communicating with an internal manifold 170. A curved surface 172 is substantially tangential to the openings 168 and is formed, in this instance, by a rod 174. A clamping bar 176 is located above the rod 174 and is movable between a clamping position adjacent the rod 174 and a spaced position thereabove. The bar 176 is moved by a fluid-operated cylinder 178 and a piston 180. The engageable member 140 is moved toward and away from the package section by fluid-operated cylinders 182 and is guided by rods 184. Similarly, the engageable member 142 is moved toward and away from the package section by cylinders 186 and is guided by rods 188.

When the engageable members 106 and 108 of the second pair 104 have moved the first package section to the station 24 below the engageable members 140 and 142, the latter members move inwardly to engage and support the package section between the engageable surfaces 144 and 164. At this time, the clamping bars 158 and 176 are in their upper positions. Air blowing through the openings 150 and 168 moves up and around the curved surfaces 154 and 172, producing a negative pressure adjacent these surfaces. This negative pressure causes the upper edge portions 134 and 136 of the package section to be pulled outwardly and onto the upper surfaces of the rods 156 and 174. At this time, the clamping bars 158 and 176 are moved downwardly to mechanically engage and hold the upper edges of the package section between the bars and the rods. The engageable members 140 and 142 are then moved outwardly to their spaced positions which open the upper edges 134 and 136 of the package section. The article 34 to be packaged is then deposited into the package section through the open upper edges. By this time, the engageable members 106 and 108 have moved apart to enable the article to drop to the bottom of the package section adjacent the previously formed heat-sealed strip extending transversely thereof near the lower edges.

The engageable members 140 and 142 are then moved inwardly once again and the heater band or strip 146 is heated to heat seal the top portion of the package section below the upper edges 134 and 136. During this time, the clamping bars 158 and 176 are moved upwardly so that when the engageable members 140 and 142 are moved to the outer positions for a second time in the packaging cycle, the completed package 32 is simply discharged or dropped and is received on the discharge conveyor 36 or other suitable means.

Figure 7:
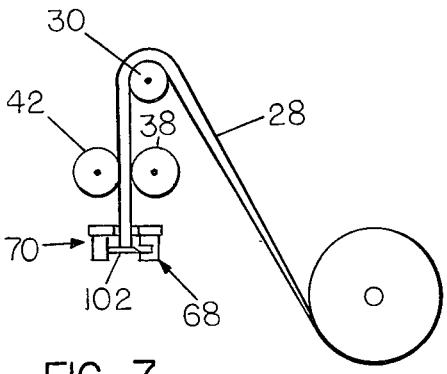
FIGS. 7—12 are schematic side views in elevation showing sequential steps in the operation of the new packaging machine.

The operation of the machine 20 can be understood from the above description but will be set forth altogether in connection with FIGS. 7–12, which are schematic side views in elevation of certain machine components. Referring to FIG. 7, the tubing 28 is shown at the beginning of the cycle, or at the end of the previous one, with the lower leading edge of the tubing having a transverse heat sealed strip thereacross. This strip is positioned at the same level as the heater band of the engageable member 68.

Figure 8:
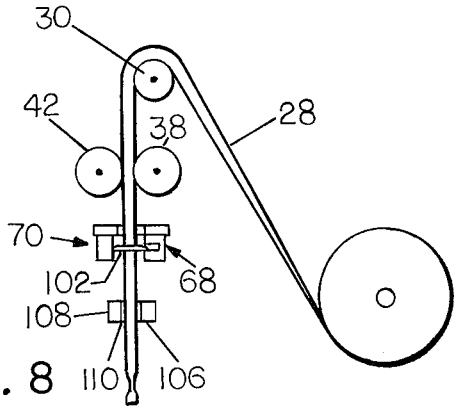

Referring to FIG. 8, the tubing 28 is then advanced a predetermined distance with another heat sealed strip then formed across the tubing at a predetermined distance thereabove. This strip is just above the line where the strip is severed by the blade 102 as it moved across the tubing under the action of the yoke 110 carrying the engageable members 106 and 108. When the strip is severed, the edges are still held by the engageable surfaces 86 and 92 (FIG. 4) of the members 68 and 70. By the time the engageable members 68 and 70 separate, the engageable members 106 and 108 have moved together to hold the first package section at a point substantially below the upper severed edges thereof.

Figure 9:
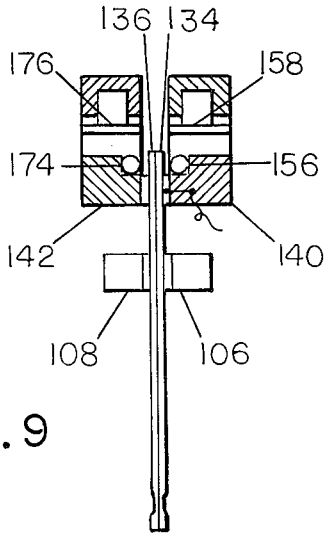

The members 106 and 108 then move back to the second station, as shown in FIG. 9, with the upper edges 134 and 136 of this first package section then being between the engageable members 140 and 142.

Figure 10:
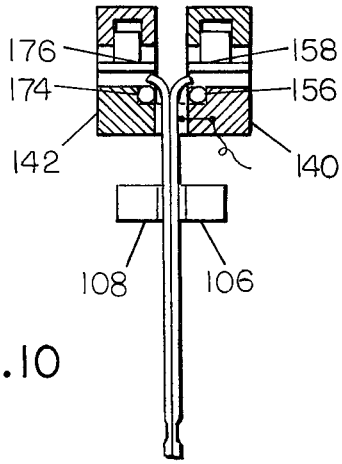

The members 140 and 142 then move together, as shown in FIG. 10, below the upper edges 134 and 136 which are moved around the rods 156 and 174 by the negative air pressure. The edges are clamped against the rods by the bars 158 and 176.

Figure 11:
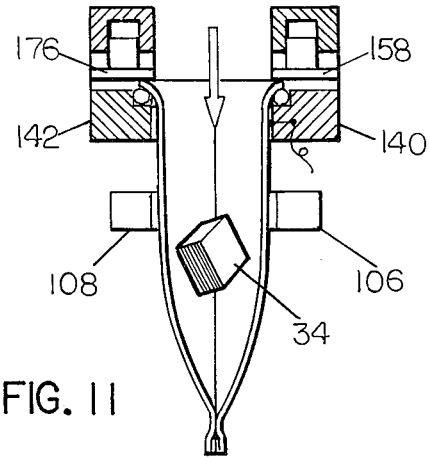

The engageable members 140 and 142 are then moved outwardly again, as shown in FIG. 11, to open the package section by separating the upper edges of it. The article 34 is then deposited therein with the engageable members 106 and 108 also having separated by this time.

Figure 12:
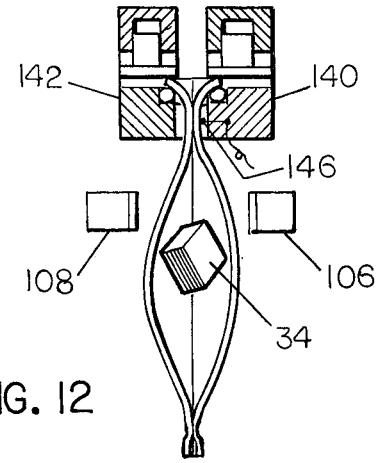

Referring to FIG. 12, the members 140 and 142 are then brought together again to cause the heater band 146 to seal the section transversely thereacross near the upper edges 134 and 136. When the engageable members 140 and 142 separate for the second time in the packaging cycle, the now-completed package 32 is discharged from the machine.

During the aforesaid steps at the second station 24, the operations at the first station 22 are repeated, with the tube 28 being advanced to place the second section below the members 68 and 70 and to heat seal what will be the lower edge of a third package section. The second package section is then ready to sever when the engageable members 106 and 108 and the yoke 110 move back to the first station again after the previous package has been discharged.

Various modifications of the above-described embodiment will be apparent to those skilled in the art and it is to be understood that such modifications can be made without departing from the scope of the invention if they are within the spirit and the tenor of the accompanying claims.

I claim:

1. A machine for making packages sequentially from a length of plain flexible tubing, said machine comprising means for advancing the tubing lengthwise, with a leading edge portion transversely sealed, through a first station and for stopping the advance, means for forming a sealed transverse strip across the tubing at a distance from the sealed leading edge portion, means for severing the tubing on the leading edge side of the sealed strip, means for transferring the severed section to a second station spaced from the first station, means for opening the severed edges of the section, said means for opening said severed edges of said section comprising means forming a curved surface extending substantially parallel to the severed edge on each side of the tubing, and means for directing air in a path over each of the curved surfaces for establishing a low pressure area adjacent the severed edge portions of the tubing to urge the edge portions outwardly, and means for closing the severed edges of the section and for sealing the section along a second transverse strip near the severed edges.

2. A machine according to claim 1 characterized by means for clamping each severed edge portion of the tubing when moved outwardly by the air.

3. A machine according to claim 2 characterized by means for moving apart the clamping means after the severed edge portions of the tubing have been clamped thereby.

4. A machine for making packages sequentially from a length of flexible tubing, said machine comprising means for supporting a supply of the tubing, at least two rolls for engaging opposite sides of the tubing, means for rotating said rolls for advancing the tubing and for stopping the rotation, means spaced downstream of said rolls for forming first sealed strips across the tubing, means downstream of said sealing means for severing the tubing, means for transferring severed sections of the tubing to a position located at one side of said seal-forming means, means for opening the severed edges of the sections, said means for opening said severed edges of the tubing comprising means forming a curved surface extending substantially parallel to the severed edge on each side of the tubing, and means for directing air past each of the curved surfaces for establishing a low pressure area adjacent the severed edge portions of the tubing, and means for closing the severed edges and for forming second sealed strips across the sections near the severed edges.

5. A machine according to claim 4 characterized by means for clamping each severed edge portion of the tubing when urged apart by the air under low pressure.

6. A machine according to claim 5 characterized by means for moving apart the clamping means after the severed edge portions of the tubing have been clamped thereby.

7. A method for making packages sequentially from a length of plain flexible tubing, said method comprising maintaining the tubing flat with the tubing positioned in a given plane, advancing the tubing lengthwise with the leading edge transversely sealed and stopping the advance, forming a sealed strip transversely across the tubing at a distance from the sealed leading edge at a first station, severing the tubing on the leading edge side of the sealed strip, transferring the severed section to a second station to one side of the first station in a direction parallel to the plane of the tubing, opening the severed edges of the section at the second station, depositing an article in the section at the second station, closing the severed edges at the second station, forming a transverse seal across the section near the severed edges at the second station, and discharging the package from the second station.

8. The method according to claim 7 characterized by repeating the advancing and first seal-forming steps while performing the opening, depositing, closing, and second seal-forming steps.

9. A machine for making packages sequentially from a length of plain, flexible plastic tubing, said machine comprising means for supporting a roll of the tubing, at least two rolls for engaging opposite sides of the tubing, means for rotating said rolls for advancing the tubing lengthwise and for stopping the rotation, means spaced downstream of said rolls for forming first sealed strips across the tubing, means downstream of said sealing means for severing the tubing into sections, means for opening and engaging the severed edges of the sections, said means for opening and engaging the severed sections comprising means forming a curved surface extending substantially parallel to the severed edge on each side of the tubing, and means for directing air past each of the curved surfaces for establishing a low pressure area adjacent the severed edge portions of the tubing, and means for closing the severed edges and for forming second sealed strips across the sections near the severed edges and spaced from the first sealed strips.

10. A machine according to claim 9 characterized by means for clamping each severed edge portion of the tubing when urged apart by the air.

11. A machine according to claim 10 characterized by means for moving apart the clamping means after the severed edge portions of the tubing have been clamped thereby.

12. A machine for making packages from a length of flexible tubing, said machine comprising means for advancing the tubing lengthwise; means spaced from said advancing means for forming first sealed strips across the tubing; means spaced from said sealing means for severing the tubing near the sealed strips into sections; means for opening and engaging the severed edges comprising means forming a curved surface extending substantially parallel to the severed edges on each side of the tubing, and means for directing air past each of the curved surfaces for establishing a low pressure area adjacent the severed edge portions of the tubing; and means for sealing the sections near the severed edges after an article has been placed therein.

13. A machine according to claim 12 characterized by means for clamping each severed edge portion of the tubing when urged apart by the air.

14. A machine for making packages sequentially from a length of plain flexible tubing, said machine comprising means for advancing the tubing lengthwise, with a leading edge portion transversely sealed, through a first station and for stopping the advance, means for forming a sealed transverse strip across the tubing at a distance from the sealed leading edge portion, means for severing the tubing on the leading edge side of the sealed strip, means for transferring the severed section to a second station spaced to one side of the first station, drive means for moving said transferring means between said first station and said second station, said transferring means having means for directly engaging said severing means to move said severing means across the width of the tubing for severing same when said transferring means is moved between said first station and said second station by said drive means, means at the second station for opening the severed edges of the section, and means at the second station for closing the severed edges of the section, for sealing the section along a second transverse strip near the severed edges, and for releasing the sealed section to enable it to drop by gravity from the second station.

15. A machine according to claim 14 characterized by said severing means comprising a blade, and means for directing the blade along a path transverse to the tubing, said engaging means moving said blade along the path between extremities on each side of the tubing.

16. A machine for making packages sequentially from a length of flexible tubing, said machine comprising means for supporting a supply of the tubing, at least two rolls for engaging opposite sides of the tubing and for maintaining the the tubing flat in a given plane, means for rotating said rolls for advancing the tubing and for stopping the rotation, means spaced downstream of said rolls for forming first sealed strips across the tubing, means downstream of said sealing means for severing the tubing, said severing means comprising a blade, means for directing the blade along a path which is transverse to the tubing, said blade being movable along the path beyond the edges of the tubing with the path of the blade being parallel to the plane of the tubing, and means for engaging both sides of the tubing on both sides of the path of the blade, means for transferring severed sections of the tubing to a position located at one side of said seal-forming means, said transferring means having means for directly engaging said severing means for causing said blade to sever the strip when said transferring means moves from the side position toward said first strip-forming means, means at the position for opening the severed edges of the sections, and means at the position for closing the severed edges, for forming second sealed strips across the sections near the severed edges, and for releasing the sealed sections to enable them to drop by gravity from the position.

* * * * *